US005197864A

United States Patent [19]

Lunzman et al.

[11] Patent Number: 5,197,864

[45] Date of Patent: Mar. 30, 1993

[54] ON-OFF PRESSURE CUTOFF CONTROL FOR A VARIABLE DISPLACEMENT HYDRAULIC PUMP

[75] Inventors: Stephen V. Lunzman, Chillicothe; John J. Krone; Lonnie J. Devier, both of Dunlap, all of Ill.

[73] Assignee: Caterpillar Inc., Peoria, Ill.

[21] Appl. No.: 821,203

[22] Filed: Jan. 16, 1992

[51] Int. Cl.[5] ..... F04B 1/26

[52] U.S. Cl. ..... 417/218; 417/222.1

[58] Field of Search ..... 417/218, 219, 220, 221, 417/222 R; 60/443

[56] References Cited

U.S. PATENT DOCUMENTS 4,523,430 6/1985 Masuda ..... 417/222 R

FOREIGN PATENT DOCUMENTS 3840548 6/1990 Fed. Rep. of Germany ..... 417/218

*Primary Examiner*—Leonard E. Smith

*Attorney, Agent, or Firm*—John W. Grant

[57] ABSTRACT

High pressure cutoff controls are useful for variable displacement hydraulic pumps for reducing power losses at high pressure levels. Some operators, however, believe that they get more work from pumps not having the high pressure cutoff control. The subject on-off high pressure cutoff control includes an on-off valve disposed in a pilot passage connected to an output port of a pump and to an end of a high pressure cutoff valve. The on-off valve is selectively movable between a first position at which pressurized fluid passes through the pilot passage to the end of the high pressure cutoff valve to prevent it from functioning as a high pressure cutoff valve. Thus, an operator has the option of operating the hydraulic pump with or without the high pressure cutoff control.

4 Claims, 1 Drawing Sheet

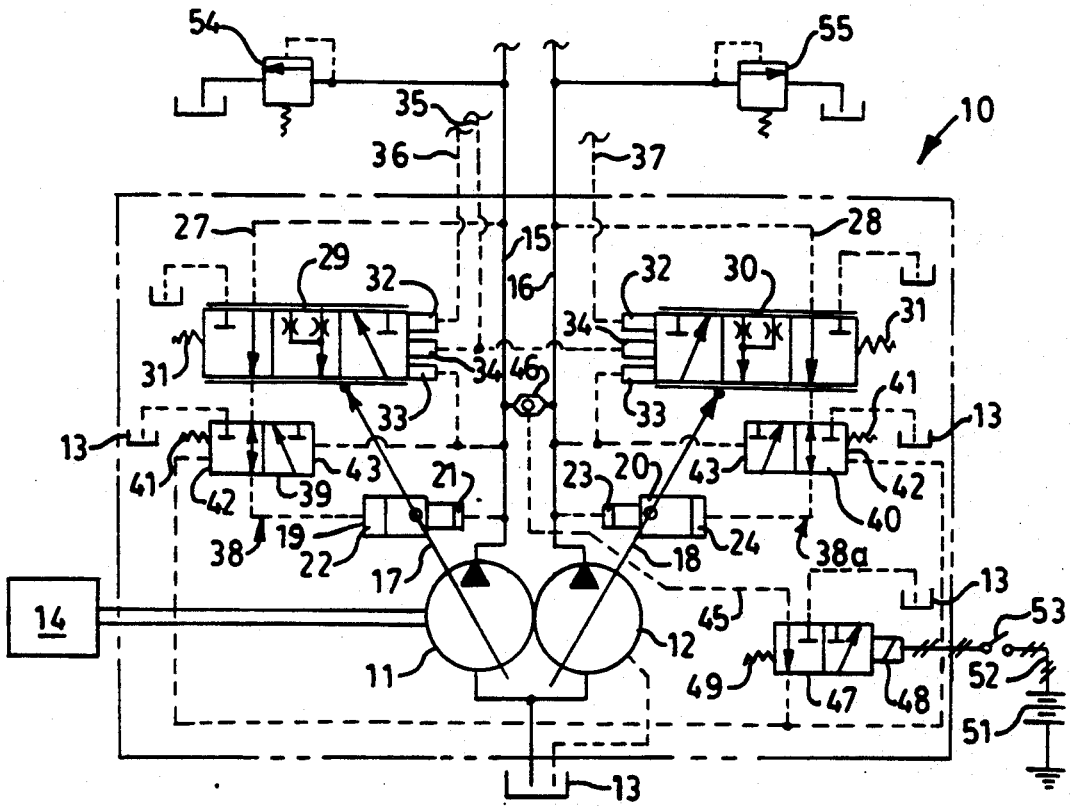
54
55
35
36
37
10
27
28
15
16
29
32
30
31
34
46
33
41
13
43
42
39
21
23
20
40
38
19
22
24
18
38a
17
14
45
53
11
12
49
47
48
52
51

ON-OFF PRESSURE CUTOFF CONTROL FOR A VARIABLE DISPLACEMENT HYDRAULIC PUMP

DESCRIPTION

1. Technical Field

This invention relates to a variable displacement hydraulic pump and, more particularly, to an on-off high pressure cutoff control therefor.

2. Background Art

Many hydraulic systems for a particular type of vehicle, such as a hydraulic excavator, utilize a pump control that has a high pressure cutoff valve. The high pressure cutoff valve functions to reduce the displacement of the pump so that pump flow is at substantially zero whenever the pump output pressure approaches the opening pressure of a main relief valve for the hydraulic system. This prevents large power losses that would occur with high pressure fluid passing through the relief valve to a tank. Many operators like this feature because it reduces power losses and, thus, saves fuel.

However, some operators believe that the vehicle is not really working hard unless the engine lugs down due to fluid flow across the relief valve during heavy loading. Thus, the hydraulic systems of some of the same type of vehicles do not have a high pressure cutoff valve such that the higher pump flow pass through the relief valve at high pressures under heavy loading of the hydraulic system.

Thus, it is desirable to provide a hydraulic system in which the individual operator can decide whether to operate the vehicle in a power saving mode or in a mode in which he believes the vehicle to be really working hard.

The present invention is directed to overcoming one or more of the problems as set forth above.

DISCLOSURE OF THE INVENTION

In one aspect of the present invention, an on-off high pressure cutoff control is provided for a variable displacement hydraulic pump having an output port, a swash plate movable between minimum and maximum displacement settings, an actuator connected to the swash plate and having an actuator chamber, and a first pilot passage communicating the outlet port with the actuating chamber. The high pressure cutoff control includes a high pressure cutoff valve disposed in the first pilot passage and movable between a first position establishing communication through the first pilot passage from the output port to the actuating chamber and a second position blocking communication through the first pilot passage, the cutoff valve having first and second ends and a spring disposed at the first end resiliently urging the cutoff valve to the first position, the second end being connected to the output port for moving the cutoff valve to the second position when the pressure in the output port exceeds a predetermined value. A second pilot passage connects the output port with the first end of the cutoff valve, and an on-off valve is disposed in the second pilot passage and is selectively movable between a first position establishing communication through the second pilot passage from the output port to the first end of the cutoff valve and a second position blocking communication through the second pilot passage.

BRIEF DESCRIPTION OF THE DRAWING

The sole figure is a schematic illustration of an embodiment of the present invention.

BEST MODE FOR CARRYING OUT THE INVENTION

A hydraulic system 10 includes a pair of variable displacement hydraulic pumps 11,12 commonly connected to a tank 13. The hydraulic pumps 11,12 are commonly driven by a power source 14 such as internal combustion engine. Each of the pumps 11,12 have an output port 15,16, a plate 17,18 movable between maximum and minimum displacement settings, and an actuator 19,20 connected to the swash plate for moving the swash plate between the maximum and minimum displacement settings. The actuator 19 has first and second actuating chambers 21,22 with the actuating chamber 21 being connected to the output port 15. The actuator 20 similarly has first and second actuating chambers 23,24 with the actuating chamber 23 being connected to the output port 16.

The hydraulic pumps 11,12 each include a first pilot passage 27,28 connecting the outlet port 15,16 to the actuating chambers 22,24 respectively of the actuators 19,20. Each of the pilot passages has a main servo control valve 29,30 disposed therein and connected to the swash plate 17,18. The control valve 29, has a spring 31 at one end thereof and a plurality of actuators 32,33,34 at the other end thereof. Similarly, the control valve 30 has a spring 31 at one end and a plurality of actuators 32,33,34 disposed at the opposite end. A common signal line 35 is connected to the actuators 34, while a pair of signal lines 36,37 are connected to the actuators 32 of the control valves 29,30, respectively. The actuators 33 are connected to the respective output ports 15 or 16.

An on-off high pressure control **38,38*a* includes a high pressure cutoff valve 39,40 disposed in the pilot passage 27,28 in series with the main control valves 29,30. Each of the cutoff valves 39,40 has a spring 41 disposed at one end 42 resiliently urging the cutoff valve to the position shown. An opposite end 43 of each cutoff valve is connected to the respective output ports 15 or 16. A pilot passage 45 is connected to the output ports 15, 16 through a shuttle valve 46 and to the ends 42 of the cutoff valves 39,40. An on-off valve 47 is disposed in the pilot passage 45 and is connected to the tank 13. The on-off valve 47 is selectively movable to a first position establishing communication through the pilot passage 45 and a second position at which fluid flow through the pilot passage 45 is blocked and the ends 42 of the on-off valves 39,40 are communicated with the tank 13. The on-off valve 47 is a solenoid valve having a solenoid 48 at one end thereof and a spring 49 at the other end. The solenoid 48 is connected to a source of electrical energy such as a battery 51 through an electrical lead line 52 and an on-off switch 53**.

A pair of relief valves 54,55 are connected to the output ports 15,16, respectively, for relieving the pressure therein when the fluid pressure exceeds a predetermined level.

INDUSTRIAL APPLICABILITY

In use, with the main control valves 29, 30 and the high pressure cutoff valves 39,40 in the position shown in the drawings, pressurized fluid from the respective output ports 15,16 passes through the pilot passages 27,28 to the chambers 22,24 causing the actuators 19,20 to move the swash plates 17,18 to their maximum displacement settings. Movement of the swash plates toward their minimum displacement settings is achieved by moving the main control valves 29,30 against the bias of the springs 31 to controllably restrict fluid flow through the pilot passages 27,28. Totally blocking fluid flow through the pilot passages 27,28 by the main control valves results in the swash plates being moved to their minimum displacement settings.

When there is no demand for fluid flow from the pumps 11,12 external pressure signals are directed through the lines 36,37 to the actuators 32 to move the main control valves 29,30 to their fluid blocking position, thereby causing the swash plates to be moved to their minimum displacement settings. The position of the swash plates 17,18 of each pump is then individually controlled to meet the demand for fluid flow by controlling the pressure level of the external signals in the lines 36,37. Simultaneous movement of the swash plates 17,18 of both pumps is controlled by controlling the pressure level of an external signal passing through the line 35 to both actuators 34. Finally, the swash plates are also individually controllably moved toward their minimum displacement setting regardless of the pressure level of the external signals when the fluid pressure in the respective output ports 15,16 exceed a first predetermined level.

Total blockage of fluid flow through the pilot passages 27,28 is also achieved by movement of the high pressure cutoff valves 39,40 against the bias of their springs 41. With the on-off valve 47 in the position shown, however, pressurized fluid from the output port 15 or 16 having the highest pressure level is transmitted through the pilot passage 45 to the ends 42 of the high pressure cutoff valves 39,40. The force generated by the pressurized fluid acting on the ends 42 combined with the springs 41 retains the high pressure cutoff valves 39,40 in the position shown. Thus with the on-off valve 47 and the high pressure cutoff valves 39 in the position shown, the pressure level of the fluid in the output port 15,16 can reach a pressure level at which one or both of the relief valves 54,55 pass fluid to the tank 13. Thus, having the on-off valve in the on position provides one mode of operation available to the operator.

A power saving mode of operation is achieved by closing the switch 53 to energize the solenoid 48 thereby moving the on-off valve 47 to its off position to vent the ends 42 of the high pressure cutoff valves 39,40 to the tank 13. Under this condition, the high pressure cutoff valves 39,40 are individually actuated to block fluid flow through the respective pilot passages 27,28 when the fluid pressure in the respective output ports 15,16 exceed a second predetermined level which is greater than the first predetermined pressure level but less than the pressure level setting of the relief valves 54,55.

In view of the above, it is readily apparent that the structure of the present invention provides an on-off high pressure control for a variable displacement pump which provides the operator with the option of operating the hydraulic system in a power saving mode or in a mode that he perceives as causing the hydraulic system to work hard.

Other aspects, objects, and advantages of this invention can be obtained from a study of the drawings, the disclosure and the appended claims.

We claim:

1. An on-off high pressure cutoff control for a variable displacement hydraulic pump having an output port, a swash plate movable between minimum and maximum displacement settings, an actuator connected to the swash plate and having an actuating chamber, and a first pilot passage connecting the outlet port with the actuating chamber comprising:

a main servo control valve disposed in the first pilot passage for controlling fluid flow therethrough, a high pressure cutoff valve disposed in the first pilot passage in series with the main servo control valve and movable between an open position and a closed position, the cutoff valve having first and second ends and a spring disposed at the first end resiliently urging the cutoff valve to the open position, the second end being connected to the output port for moving the cutoff valve to the closed position when the pressure in the output port exceeds a predetermined high pressure level;

a second pilot passage connecting the output port to the first end of the cutoff valve; and an on-off valve disposed in the second pilot passage and selectively movable between an open position establishing communication through the second pilot passage from the output port to the first end of the cutoff valve and a closed position blocking communication through the second pilot passage.

2. An on-off high pressure cutoff control for a variable displacement hydraulic pump having an output port, a swash plate movable between minimum and maximum displacement settings, an actuator connected to the swash plate and having an actuating chamber, and a first pilot passage connecting the outlet port with the actuating chamber comprising:

a two position high pressure cutoff valve disposed in the first pilot passage and movable between a first position establishing communication through the first pilot passage from the output port to the actuating chamber and a second position blocking communication through the first pilot passage, the cutoff valve having first and second ends and a spring disposed at the first end resiliently urging the cutoff valve to the first position; the second end being connected to the output port for moving the cutoff valve to the second position when the pressure in the output port exceeds a predetermined level;

a second pilot passage connecting the output port to the first end of the cutoff valve; and an two position on-off valve disposed in the second pilot passage and selectively movable between a first position establishing communication through the second pilot passage from the output port to the first end of the cutoff valve and a second position blocking communication through the second pilot passage.

3. The on-off high pressure cutoff control of claim 2, wherein the on-off valve includes a spring resiliently urging the valve to the first position.

4. The on-off high pressure cutoff control of claim 2, wherein the on-off valve is solenoid actuated and has a solenoid connected thereto and including a source of electrical energy, and a switch for selectively connecting the source of electrical energy to the solenoid.

* * * * *